US005632150A

United States Patent [19]

Henzler

[11] Patent Number: 5,632,150

[45] Date of Patent: May 27, 1997

[54] CARBON DIOXIDE PELLET BLAST AND CARRIER GAS SYSTEM

[75] Inventor: Gregory W. Henzler, Naperville, Ill.

[73] Assignee: Liquid Carbonic Corporation, Oak Brook, Ill.

[21] Appl. No.: 480,181

[22] Filed: Jun. 7, 1995

[51] Int. Cl.[6] ..... B24B 49/14; B24C 3/12; F17C 7/02; B65B 63/08

[52] U.S. Cl. ..... 62/52.1; 62/60; 451/39; 451/53; 451/75; 451/446; 451/7

[58] Field of Search ..... 451/39, 40, 53, 451/75, 99, 446, 7; 62/52.1, 60, 77, 292; 134/7; 141/82; 220/421, 424

[56] References Cited

U.S. PATENT DOCUMENTS

| | | | |
|---|---|---|---|
| 4,038,786 | 8/1977 | Fong | 51/321 |
| 4,389,820 | 6/1983 | Fong et al. | 51/410 |
| 4,481,779 | 11/1984 | Barthel | 62/46.3 |
| 4,495,775 | 1/1985 | Young et al. | 62/46.3 |
| 4,617,064 | 10/1986 | Moore | 134/7 |
| 5,184,427 | 2/1993 | Armstrong | 81/165.73 |
| 5,319,946 | 6/1994 | Manificat | 62/342 |
| 5,321,955 | 6/1994 | Leonard | 62/51.1 |
| 5,365,699 | 11/1994 | Armstrong et al. | 451/7 |
| 5,445,553 | 8/1995 | Cryer et al. | 451/7 |

*Primary Examiner*—Timothy V. Eley
*Attorney, Agent, or Firm*—Fitch, Even, Tabin & Flannery

[57] ABSTRACT

An improved blast cleaning system and an improved method of blast cleaning using solid carbon dioxide pellets is provided. A compressed air source—preferably an air compressor—is used to produce a compressed air or carrier gas stream which is cooled to the desired temperature by injection of a cryogen—preferably liquid nitrogen—before the solid carbon dioxide pellets are introduced into the carrier gas stream. Solid carbon dioxide pellets are then added to the cooled compressed air stream and then propelled towards the surface to be cleaned. Using a compressed air stream which is precooled to the desired operating temperature helps to minimize the sublimation of the carbon dioxide pellets. The use of the precooled compressed air stream also allows greater control of the hardness, size, density, impact forces, stripping rates, and stripping efficiencies of the carbon dioxide pellets. An improved method of transporting solid carbon dioxide pellets which can be used for nonblasting applications (e.g., charging shipping containers for frozen or chilled foods) is also provided.

28 Claims, 1 Drawing Sheet

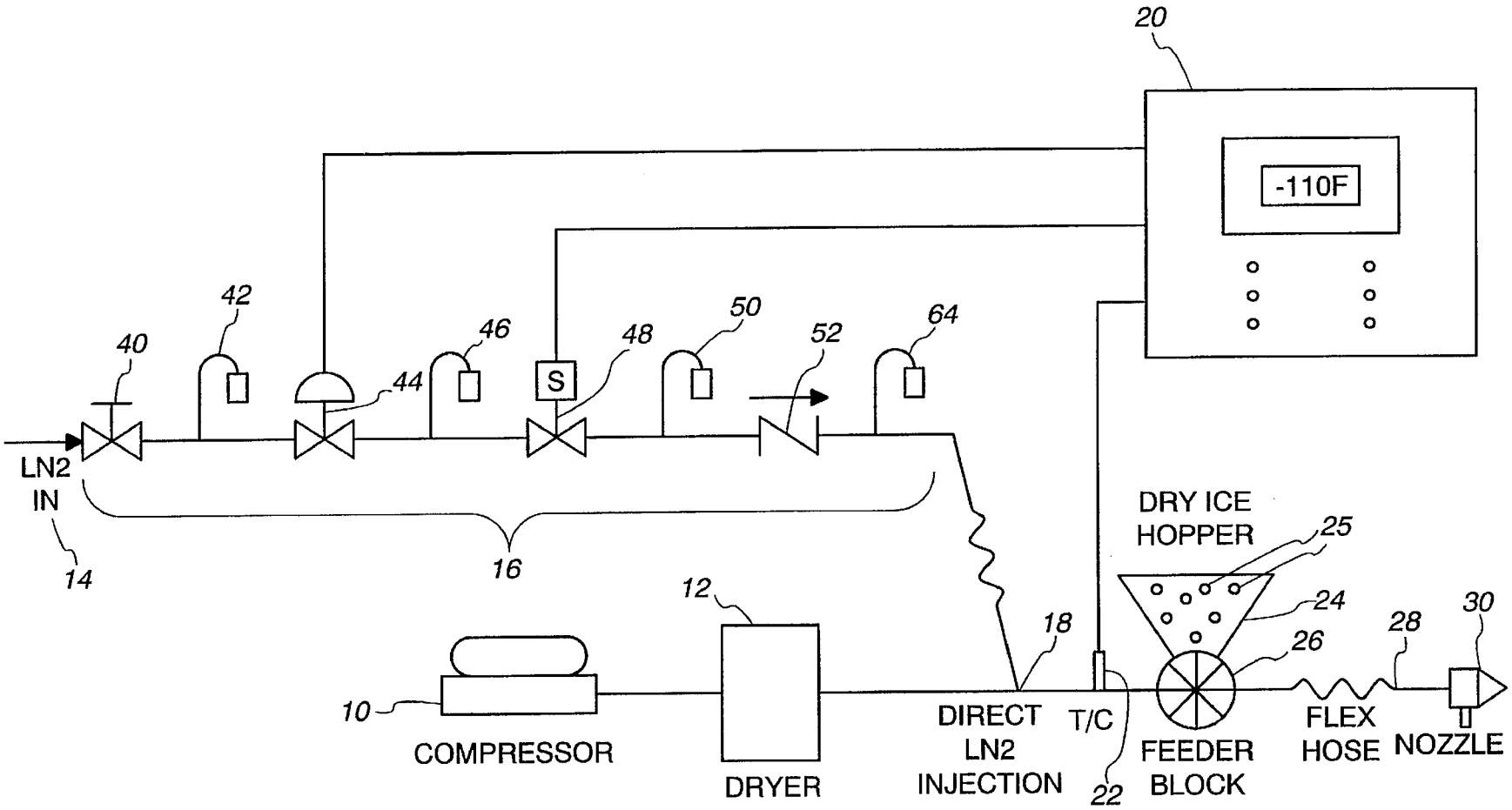
-110F
20
30
NOZZLE
28
FLEX HOSE
25
24
26
DRY ICE HOPPER
FEEDER BLOCK
22
T/C
18
DIRECT LN2 INJECTION
64
52
50
48
S
46
44
42
40
16
12
DRYER
10
COMPRESSOR
LN2 IN
14

CARBON DIOXIDE PELLET BLAST AND CARRIER GAS SYSTEM

FIELD OF THE INVENTION

In one embodiment, this invention relates to an improved carbon dioxide blast cleaning system. More specifically, this invention relates to a carbon dioxide pellet blast cleaning system using a compressed air stream to which a cryogenic gas is added to control the temperature of the air/$CO_2$ pellet stream. This invention also relates to a method of blast cleaning and/or treating surfaces using this improved carbon dioxide pellet blast system. In another embodiment, this invention also relates to a system with improved efficiencies for pneumatically carrying $CO_2$ pellets for non-blasting applications (e.g., cooling and/or refrigeration).

BACKGROUND OF THE INVENTION

Solid carbon dioxide pellets have been used as an abrasive to clean paint, coatings, or other materials from surfaces. Since solid carbon dioxide evaporates or sublimes under ambient conditions, there is no abrasive residue remaining from the pellets themselves after the cleaning operation. Thus solid carbon dioxide blast systems are especially preferred where large quantities of residue (e.g., sand from sandblasting operations) would be difficult to remove or where contamination from the residue would be undesirable.

Fong, U.S. Pat. No. 4,038,786 (Aug. 2, 1977) provided a solid carbon dioxide blast system using an air compressor to propel the carbon dioxide pellets. To reduce sublimation of the carbon dioxide pellets in the warm compressed air stream, Fong recommended that the dwell time of the carbon dioxide pellets in the carrier gas be kept to a minimum. Fong also recommended "cooling jackets" on the conduit leading from the compressor to the mixing chamber and on the carbon dioxide pellet hopper. Fong et al., U.S. Pat. No. 4,389,820 (June 28, 1983) provided another solid carbon dioxide blast system using vaporized carbon dioxide as the carrier gas. To prevent plugging up the system (i.e., clumping of the carbon dioxide pellets or formation of carbon dioxide snow), the carrier gas was heated to about 250° to 275° F.; the carrier gas temperature was never allowed to fall below 100° F. With the carrier gas at these high temperatures, there will clearly be significant losses from the carbon dioxide pellets from sublimation.

Moore, U.S. Pat. No. 4,617,064 (Oct. 14, 1986) provided a solid carbon dioxide blast system using solid carbon dioxide pellets propelled with compressed air directly from an air compressor. Compressed air directly from a conventional air compressor will be relatively warm (i.e., 70° to 100° F. or higher). Moore used a rotary feed system to mix the compressed air and solid carbon dioxide pellets. The rotary feed system employed various seals to prevent the carrier gas from entering the carbon dioxide pellet storage container where, because of water vapor possibly present in the carrier gas, clumping of the carbon dioxide pellets might occur. The carbon dioxide pellet storage container was also pressurized with a positive pressure of carbon dioxide gas to minimize leakage of water vapor into the container.

More recently, Armstrong, U.S. Pat. No. 5,184,427 (Feb. 9, 1993) and Armstrong et al., U.S. Pat. No. 5,365,699 (Nov. 22, 1994) provided a carbon dioxide blast system using only cryogen (e.g., vaporized liquid nitrogen) as the carrier gas. The air compressor normally used in the carbon dioxide blast systems was completely eliminated in this design. The carrier gas was generated by vaporizing the cryogen (preferably using an ambient air vaporizer). In this manner, the temperature of the carrier gas could be controlled between about −200° F. and ambient. This carbon dioxide blast system used large quantities of cryogens. Moreover, liquid oxygen was sometimes required to be used in conjunction with the normal liquid nitrogen cryogen when the blast system was to be used on closed or confined areas. Workers in such closed or confined areas could still be exposed to significant danger if, for example, the liquid oxygen supply system failed or the oxygen levels fell below safe levels. For this reason, an oxygen alarm was recommended. In addition, liquid oxygen itself can present hazards, including the possibility of rapid oxidation and increased fire hazards.

It would be desirable, therefore, to provide a carbon dioxide blast system which minimizes and controls the sublimation of the solid carbon dioxide pellets. It would also be desirable to provide a carbon dioxide blast system which employs compressed air which can be cooled to a relatively low temperature, thereby minimizing the sublimation of the carbon dioxide pellets while at the same time allowing greater control of the hardness, size, density, impact forces, stripping rates, and stripping efficiencies of the carbon dioxide pellets. It would also be desirable to provide a carbon dioxide blast system which does not consume large quantities of cryogen and/or which does not require the use of liquid oxygen. It would also be desirable to provide a carbon dioxide blast system which significantly reduces the risks associated with using the system in closed or confined spaces. It would also be desirable to provide an improved method of pneumatically carrying carbon dioxide pellets which can be used in both blasting and non-blasting applications. The present invention provides such a carbon dioxide blast system and a pneumatically carried carbon dioxide pellet system.

SUMMARY OF THE INVENTION

In a first embodiment, the present invention relates to an improved blast cleaning system and an improved method of blast cleaning. The present invention employs a compressed air source—preferably an air compressor—to produce a compressed air or carrier gas stream which is cooled to the desired temperature by injection of a cryogen—preferably liquid nitrogen—before the solid carbon dioxide pellets are introduced into the carrier gas stream. Solid carbon dioxide pellets are then added to the cooled compressed air stream and then propelled towards the surface to be cleaned.

In a second embodiment, this invention provides an improved system and method for pneumatically carrying carbon dioxide pellets. This improved pneumatic system can be used for both blasting and non-blasting applications. Examples of such non-blasting applications include material cooling and storage (especially food cooling, storage, and transportation).

One object of the present invention is to provide a blast cleaning system for cleaning surfaces with solid carbon dioxide pellets, said system comprising:

(1) a compressed air source for producing a high pressure compressed air stream;

(2) a cryogenic supply of liquified gas and means for producing a stream of the liquified gas;

(3) means for introducing the stream of liquified gas into the high pressure compressed air stream to produce a cold high pressure compressed air stream at a predetermined temperature of about 0° to −300° F.;

(4) solid carbon dioxide pellets;

(5) means for mixing the solid carbon dioxide pellets and the cold high pressure compressed air stream; and (6) means for propelling the mixture of solid carbon dioxide pellets and cold high pressure compressed air stream towards the surface to be cleaned.

Another object of the present invention is to provide a blast cleaning system for cleaning surfaces with solid carbon dioxide pellets, said system comprising:

(1) a compressor for producing a high pressure compressed air stream;

(2) a supply of liquid nitrogen and means for producing a stream of the liquid nitrogen;

(3) means for introducing the stream of liquid nitrogen into the high pressure compressed air stream to produce a cold high pressure compressed air stream at a predetermined temperature of about 0° to −300° F.;

(4) a temperature controller for adjusting and controlling the amount of liquid nitrogen introduced into the high pressure compressed gas stream in order to achieve the predetermined temperature for the cold high pressure compressed air stream;

(5) solid carbon dioxide pellets;

(6) means for mixing the solid carbon dioxide pellets and the cold high pressure compressed air stream; and (7) means for propelling the mixture of solid carbon dioxide pellets and cold high pressure compressed air stream towards the surface to be cleaned.

Still another object of the present invention is to provide a method for blast cleaning a surface with solid carbon dioxide pellets, said method comprising (1) providing a stream of high pressure compressed air;

(2) drying the stream of high pressure compressed air;

(3) injecting a cryogen into the stream of dried high pressure compressed air to form a cold high pressure compressed air stream at a predetermined temperature in the range of about 0° to −300° F.;

(4) mixing solid carbon dioxide pellets into the cold high pressure compressed air stream; and (5) propelling the mixture of solid carbon dioxide pellets and cold high pressure compressed air stream onto the surface to be cleaned.

Still another object of this present invention is to provide a method for pneumatically carrying solid carbon dioxide pellets, said method comprising (1) providing a stream of carrier gas;

(2) drying the stream of carrier gas;

(3) injecting a cryogen into the dried stream of carrier gas to form a cold carrier gas stream at a predetermined temperature of about 0° to −300° F.;

(4) mixing solid carbon dioxide pellets into the cold carrier gas stream to provide a stream of pneumatically carried carbon dioxide pellets; and (5) delivering the pneumatically carried carbon dioxide pellets to a desired location.

Still another object of this present invention is to provide a system for pneumatically transporting solid carbon dioxide pellets to a desired location, said system comprising (1) carrier gas source for producing a carrier gas stream;

(2) a cryogenic supply of liquified gas and means for producing a stream of the liquified gas;

(3) means for introducing the stream of liquified gas into the carrier gas stream to produce a cold carrier gas stream at a predetermined temperature of about 0° to −300° F.;

(4) solid carbon dioxide pellets;

(5) means for mixing the solid carbon dioxide pellets and the cold carrier gas stream; and (6) means for delivering the mixture of solid carbon dioxide pellets and cold carrier gas stream to a desired location.

These and other objects and advantages of the present invention will become apparent through the following description of the drawing and preferred embodiments of the invention.

BRIEF DESCRIPTION OF THE DRAWING

The FIGURE is a schematic diagram of a preferred carbon dioxide pellet blast cleaning system.

DETAILED DESCRIPTION OF THE INVENTION

In a first embodiment, the present invention relates to an improved blast cleaning system and an improved method of blast cleaning. The present invention employs a compressed air source to produce a compressed air or carrier gas stream which is cooled to the desired temperature by injection of a cryogen. The cooled compressed air stream is then used to propel solid carbon dioxide pellets towards a surface to be cleaned. Using a compressed air stream which is precooled to the desired operating temperature helps to minimize the sublimation of the carbon dioxide pellets within the blast cleaning system. The use of the precooled compressed air stream also allows greater control of the hardness, size, density, impact forces, stripping rates, and stripping efficiencies of the carbon dioxide pellets.

Suitable compressed air sources include high pressure compressed air tanks, in-house high pressure air supplies, and air compressors. Preferably the pressure of the compressed air stream is about 80 to 350 psi, and more preferably about 150 to 250 psi. Preferably the pressure of the compressed air can be controlled and varied by suitable pressure regulating devices. Preferably the compressed air source is a conventional air compressor operating at about 100 to 250 psi; both tank and tankless type compressors can be used. Typically the compressed air stream produced from such a conventional air compressor will be relatively warm (i.e., temperatures of about 70° to 100° F. or higher) and may contain significant water vapor (depending on the relative humidity of the air being compressed). Preferably, therefore, the compressed air stream is dried to sufficiently low levels before it is precooled whereby ice formation and/or $CO_2$ pellet clumping does not occur in the carrier gas to a significant and/or detrimental extent. Generally it is preferred that the carrier gas is dried to a level of less than about 0.1 volume percent water and preferably less than about 0.02 volume percent water. Preferably the dew point of the dried compressed air should be below about −40° F. Drying of the compressed air stream will not be required in all cases; for example, compressed air from high pressure tanks (which will normally have low levels of water vapor) may not require a separate drying step. However, as an added precaution, it is generally preferred that the compressed air carrier stream be dried before injection of the cryogen. The compressed air stream may be dried using conventional air drying techniques and equipment. Desiccant beds are generally the preferred air drying systems, with an activated alumina desiccant bed being especially preferred. Refrigeration drying systems, as well as other types, can also be used.

The compressed air stream is cooled by injection of a cryogen. Suitable cryogens included nitrogen, carbon dioxide, helium, and mixtures thereof supplied under high pressure. The preferred cryogen is liquid nitrogen. By controlling the relative amount of cryogen injected into the compressed air stream, the temperature of the precooled carrier gas can be controlled and varied over a wide range. For example, using liquid nitrogen as the cryogen, temperatures from about −300° up to about 0° F. can be readily obtained. Preferably, the temperature of the precooled carrier gas is in the range of about 0° to −150° F. Preferably the cryogen is injected into the carrier gas stream as a liquid (e.g. liquid nitrogen). Cryogen which has been vaporized (but still remains cold) can also be injected directly into the carrier gas. As one skilled in the art will realize, liquid cryogen injected into the warm carrier gas stream will almost immediately vaporize.

The carrier stream consists of air and the injected cryogen. Although precautions should still be taken, the blasting system of the present invention presents relatively fewer safety concerns when used in relatively closed or confined areas since the carrier gas contains oxygen. Of course, proper ventilation and oxygen monitoring should still be employed as required by OSHA standards.

Solid carbon dioxide pellets (i.e., dry ice pellets) are fed into and mixed with the precooled carrier gas using conventional feeding techniques. The solid carbon dioxide pellets are the size and shape conventionally used in carbon dioxide blasting systems. Thus, for example, the solid carbon dioxide pellets may be round, oblong, elliptical, rice-shaped, irregular, and the like. Generally, the solid carbon dioxide pellets are less than about ⅛ inches in diameter (assuming round pellets). The solid carbon dioxide pellets may be manufactured on-site or off-site using conventional carbon dioxide pellet manufacturing techniques and equipment. If manufactured on-site, it is generally preferred that an integral pelletizer be incorporated into the blast cleaning system. If manufactured off-site, it is generally preferred that the solid carbon dioxide pellets are delivered to the site in an insulated storage container which, even more preferably, is adapted to fed directly into or connect to the solid carbon dioxide pellet hopper on the blast cleaning system. Preferably the solid carbon dioxide pellet hopper is insulated. The solid carbon dioxide pellets are fed into the cold carrier stream from the solid carbon dioxide pellet hopper using conventional material handling techniques and equipment. Preferably, the solid carbon dioxide pellets are gravity fed into the cold carrier stream through a rotating block feed unit. Preferably, the feed unit is sealed to prevent significant leakage of carrier gas back through or into the solid carbon dioxide hopper.

The mixture of solid carbon dioxide pellets and the cold carrier gas is then propelled, at relatively high pressures and velocities, through an appropriate hose and nozzle/gun assembly onto the surface to be cleaned. Typically the pressure at the nozzle will be in the range of about 100 to 250 psi. Higher and lower pressures and velocities can be used so long as the blast system can effect the desired cleaning. The propelling force is provided by the high pressure cold compressed air stream. If desired, however, additional means can be used to boost the propelling force; for example, boosting pumps and/or nozzle designs can be used to increase the pressure of the propelled solid carbon dioxide and cold carrier gas stream. Preferably the hose is flexible (and remains so at the operating temperature of the system). Preferably the hose is insulated to better maintain the carrier stream at the desired blasting temperature and to protect the operator from cold burns.

A preferred blast cleaning system is shown in the FIGURE. Air compressor 10 supplies a warm compressed air stream which is dried in air dryer 12 to remove water vapor. Typically, a conventional air compressor is used to provided compressed air at pressures up to about 270 psi and temperatures of about 70° to 100° F. Appropriate pressure regulating devices (not shown) can be used to adjust the pressure of the compressed air to the desired operating pressure (typically in the range of about 100 to 250 psi). The compressor 10 will, of course, require some type of power supply (not shown). Cryogen 14 (preferably liquid nitrogen) is fed via control system 16 and then injected into the warm compressed air stream (carrier gas) at point 18. A thermocouple 22 (or other temperature measuring device) measures the temperature of the compressed air after cryogen injection and relays this measurement to the control unit 20. The temperature measuring device should normally be located far enough downstream of the injection point 18 so that a representative equilibrium temperature can be measured for the cooled carrier gas. Control unit 20, in conjunction with control system 16, effectively adjusts and controls the amount of cryogen injected into the warm carrier gas in order to maintain the temperature of the carrier gas at the desired temperature. Generally, the temperature of the cooled carrier gas will be maintained at about 0° to −110° F. (or below); of course, higher or lower temperatures can be used if desired. The cooled carrier gas is then fed into the feeder block 26 wherein solid carbon dioxide pellets 25 from dry ice hopper 24 are added to the cooled carrier gas stream. Although not shown, the dry ice hopper can be cooled (in order to reduce sublimation of the pellets within the hopper and/or to reduce the temperature of the pellets before addition to the carrier gas) using injection of a cryogen (preferably the same cryogen used to cool the carrier gas) into the dry ice hopper 24. If desired, a temperature control system (similar to 16 and 20) could be used to control the temperature of the pellets 25 in the dry ice hopper 24. The carbon dioxide pellets can be produced on-site (i.e., in a pelletizer as an integral part of the blast cleaning system; not shown) or manufactured off-site and transported to the site in a suitable container. The carrier gas/pellet mixture is discharged through the flexible hose 28 and nozzle 30 onto the surface to be cleaned to effect the cleaning operation.

As noted above, the temperature of the carrier gas is adjusted by the amount of liquid nitrogen (or other cryogen) injected into the warm carrier gas from the air compressor 10. Control unit 20, in conjunction with control system 16, effectively adjusts and controls the amount of cryogen injected into the warm carrier gas to maintain the carrier gas at the desired preselected or predetermied temperature. Control unit 20 may be any conventional controller (i.e., analog, digital, computer). The cryogen control system 16 in the FIGURE consists of the liquid nitrogen supply line 14, a manual control valve 40, pressure relief valves 42, 46, 50, and 54, control valve 44, solenoid valve 48, and check valve 52.

Controller 20 controls both the control valve 44 and the solenoid valve 48. The solenoid valve 48 is an on/off valve. Control valve 44 is used to adjust the amount of liquid nitrogen injected into the warm compressed air stream at point 18. The preselected temperature is selected by the operator using controller 20. The controller 20 then compares the preselected temperature with the temperature of the cooled carrier gas as measured by the thermocouple 22. If the measured temperature is higher than the preselected temperature, control valve 44 is opened (or opened further) to allow additional liquid nitrogen to be injected into the warm carrier gas stream. If the measured temperature is lower than the preselected temperature, control valve 44 is closed (or partially closed) to stop or restrict liquid nitrogen from entering the warm carrier gas stream. The amount of the opening or closing of the control valve 44 will generally be proportional to the difference between the measured and preselected temperatures. Pressure relief valves 42, 46, 50, and 54 prevent the build up of excessive and potentially dangerous pressure levels in each separate compartment of the control system 16. Check valve 52 prevents the flow of carrier gas back into the control system 16. As one of ordinary skill in the art will realize, other valve and control arrangements can be used in the present blast cleaning system so long as the amount of cryogen injected into the warm compressed air stream is controlled to achieve the desired temperature for the cooled compressed air stream.

In a second embodiment, this invention also relates to a system and a method for pneumatically carrying solid carbon dioxide pellets. The system and method are essentially as described above for the blast system. There are, of course, certain modifications that can be made in this more general system and method relative to the blast system described above. For example, the carrier gas in this second embodiment may be air or compressed air as in the first embodiment or an inert gas (e.g., nitrogen). Generally, however, the carrier gas is air. In addition, it is not necessary for the carrier gas to be at high pressure since a high propelling force is not required for non-blasting applications. Although similar type compressed air sources can be used as in the first embodiment, it is generally preferred that the pressure is regulated at lower levels so as to avoid the abrading effect of the carbon dioxide pellets. For pneumatically carrying carbon dioxide pellets, a pressure of less than about 10 psi, and preferably less than about 1 psi, for the carrier gas is generally sufficient; higher and lower pressures can be used, if desired, so long as the velocity of the carrier gas is sufficient to carry the solid carbon dioxide pellets to the desired location. Thus, because lower pressures can be used, the air source can also include, for example, an air blower. As is apparent, a nozzle (reference number 30 in the FIGURE) is not required for non-blasting operations. Rather, the nozzle is replaced by suitable piping or hoses to deliver the solid carbon dioxide pellets to the desired location. Otherwise, the pneumatically carried solid carbon dioxide system is operated in essentially the same manner as described for the blast system.

This second embodiment can be used to carry or transport solid carbon dioxide pellets to a desired location with significantly reduced losses associated with carbon dioxide sublimation. Thus, this present method allows shipping containers (e.g., for frozen or chilled food shipments) to be charged with solid carbon dioxide pellets more efficiently. Such solid carbon dioxide pellets could be added to shipping container filled with frozen or chilled food in order to maintain product quality during shipment and/or to extend distribution routes. Moreover, the carrier gas can be cooled below carbon dioxide's sublimation temperature (e.g., below about −110° F.) to increase the refrigeration valve stored in the solid carbon dioxide pellets. The pellets themselves could also cooled to similar temperatures before being injected into the carrier gas thereby increasing the overall efficiency of the refrigeration system. Generally, such a refrigeration system would preferably be operated at about −120° to −300° F. Such a system is expected to result in better food quality, longer distribution routes, and decrease shipping and fuel costs.

That which is claimed is:

1. A method for pneumatically carrying solid carbon dioxide pellets, said method comprising (1) providing a stream of carrier gas;

(2) drying the stream of carrier gas;

(3) injecting a cryogen into the dried stream of carrier gas to form a cold carrier gas stream at a predetermined temperature of about 0° to −300° F.;

(4) mixing solid carbon dioxide pellets into the cold carrier gas stream to provide a stream of pneumatically carried carbon dioxide pellets; and (5) delivering the pneumatically carried carbon dioxide pellets to a desired location.

2. A method as defined in claim 1, wherein the cryogen is liquid nitrogen and the carrier gas is air.

3. A method as defined in claim 2 further comprising a temperature controller whereby the amount of cryogen injected into the carrier gas stream can be adjusted and controlled in order to achieve the predetermined temperature for the cold carrier gas stream.

4. A method as defined in claim 3, wherein the stream of carrier gas is generated with an air compressor.

5. A method as defined in claim 4, wherein the solid carbon dioxide pellets are cooled by a second injection of a second cryogen prior to mixing with the cold carrier gas stream.

6. A method as defined in claim 4, wherein the pneumatically carried carbon dioxide pellets are used to cool a shipping container.

7. A method as defined in claim 3, wherein the stream of carrier gas is generated with an air blower.

8. A method as defined in claim 7, wherein the solid carbon dioxide pellets are cooled by a second injection of a second cryogen prior to mixing with the cold carrier gas stream.

9. A method as defined in claim 7, wherein the pneumatically carried carbon dioxide pellets are used to cool a shipping container.

10. A method as defined in claim 3, wherein the solid carbon dioxide pellets are cooled by a second injection of a second cryogen prior to mixing with the cold carrier gas stream.

11. A method as defined in claim 3, wherein the pneumatically carried carbon dioxide pellets are used to cool a shipping container.

12. A method as defined in claim 3, wherein the temperature controller has a temperature sensor to measure the temperature of the cold carrier gas stream.

13. A method as defined in claim 1 further comprising a temperature controller whereby the amount of cryogen injected into the carrier gas stream can be adjusted and controlled in order to achieve the predetermined temperature for the cold carrier gas stream.

14. A method as defined in claim 13, wherein the stream of carrier gas is generated with an air blower.

15. A method as defined in claim 13, wherein the solid carbon dioxide pellets are cooled by a second injection of a second cryogen prior to mixing with the cold carrier gas stream.

16. A method as defined in claim 15, wherein the temperature controller has a temperature sensor to measure the temperature of the cold carrier gas stream.

17. A method as defined in claim 2, wherein the stream of carrier gas is generated with an air compressor.

18. A method as defined in claim 2 wherein the solid carbon dioxide pellets are prepared using an integral carbon dioxide pelletizer.

19. A method as defined in claim 18, where in the pneumatically carried carbon dioxide pellets are used to cool a shipping container.

20. A method as defined in claim 2, wherein the pneumatically carried carbon dioxide pellets are used to cool a shipping container.

21. A method as defined in claim 1, wherein the pneumatically carried carbon dioxide pellets are used to cool a shipping container.

22. A method as defined in claim 2, wherein the amount of cryogen injected into the stream of dried carrier gas ms controlled and adjusted by a temperature controller having a temperature sensor to measure the temperature of the cold carrier gas stream, whereby the temperature controller compares the measured temperature to the predetermined temperature.

23. A system for pneumatically transporting solid carbon dioxide pellets to a desired location, said system comprising (1) a carrier gas source for producing a carrier gas stream;

(2) a cryogenic supply of liquified gas and means for producing a stream of the liquified gas;

(3) means for introducing the stream of liquified gas into the carrier gas stream to produce a cold carrier gas stream at a predetermined temperature of about 0° to −300° F.;

(4) solid carbon dioxide pellets;

(5) means for mixing the solid carbon dioxide pellets and the cold carrier gas stream; and (6) means for delivering the mixture of solid carbon dioxide pellets and cold carrier gas stream to a desired location.

24. A system as defined in claim 23, wherein the carrier gas is air and the liquified gas is liquid nitrogen.

25. A system as defined in claim 24 further comprising a temperature controller for adjusting and controlling the amount of liquified gas introduced into the carrier gas stream in order to achieve the predetermined temperature for the cold carrier gas stream.

26. A system as defined in claim 25, wherein the temperature controller has a temperature sensor to measure the temperature of the cold carrier gas stream and to compare the measured temperature to the predetermined temperature.

27. A system as defined in claim 26 further comprising a shipping container, wherein the shipping container is the desired location to which the mixture of solid carbon dioxide pellets and cold carrier gas stream is delivered.

28. A system as defined in claim 25 further comprising a shipping container, wherein the shipping container is the desired location to which the mixture of solid carbon dioxide pellets and cold carrier gas stream is delivered.

* * * * *